US011569023B2

(12) United States Patent
Noya et al.

(10) Patent No.: US 11,569,023 B2
(45) Date of Patent: Jan. 31, 2023

(54) WIRE-WOUND INDUCTOR COMPONENT

(71) Applicant: Murata Manufacturing Co., Ltd., Kyoto-fu (JP)

(72) Inventors: Sunao Noya, Nagaokakyo (JP); Kouhei Makiuchi, Nagaokakyo (JP); Koji Okuda, Nagaokakyo (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 394 days.

(21) Appl. No.: 16/828,422

(22) Filed: Mar. 24, 2020

(65) Prior Publication Data

US 2020/0312527 A1 Oct. 1, 2020

(30) Foreign Application Priority Data

Mar. 26, 2019 (JP) ..... JP2019-058921

(51) Int. Cl.
*H01F 27/28* (2006.01)
*H01F 27/29* (2006.01)
*H01F 27/24* (2006.01)

(52) U.S. Cl.
CPC ..... *H01F 27/2823* (2013.01); *H01F 27/24* (2013.01); *H01F 27/29* (2013.01)

(58) Field of Classification Search
CPC ..... H01F 27/2823; H01F 27/24; H01F 27/29; H01F 27/292; H01F 17/045;
(Continued)

(56) References Cited

U.S. PATENT DOCUMENTS

2003/0071704 A1* 4/2003 Toi ..... H01F 27/36 336/83
2012/0133469 A1* 5/2012 Tomonari ..... H01F 27/292 336/192
(Continued)

FOREIGN PATENT DOCUMENTS

CN 108987040 A 12/2018
JP S51-038060 A 3/1976
(Continued)

OTHER PUBLICATIONS

An Office Action; "Notice of Reasons for Refusal," mailed by the Japanese Patent Office dated Nov. 2, 2021, which corresponds to Japanese Patent Application No. 2019-058921 and is related to U.S. Appl. No. 16/828,422 with English translation.

*Primary Examiner* — Lincoln D Donovan
*Assistant Examiner* — Alex W Lam
(74) *Attorney, Agent, or Firm* — Studebaker & Brackett PC

(57) ABSTRACT

A wire-wound inductor component includes a core including an axial portion that extends in an axial direction and is pillar-shaped and a first support and a second support disposed respectively on a first end and a second end in the axial direction of the axial portion; a first terminal electrode and a second terminal electrode disposed respectively on a bottom face of the first support and a bottom face of the second support; a wire wound around the axial portion, with first and second end portions of the wire being connected respectively to the first and second terminal electrodes; and a cover member that covers at least part of the wire on an upper face of the axial portion and has a terminal indentation depth of 0.85 μm or more. The adhesive strength of a top face of the cover member is less than or equal to 3.28 gf/mm$^2$.

20 Claims, 6 Drawing Sheets

(58) Field of Classification Search
CPC ..... H01F 27/306; H01F 27/34; H01F 27/006; H01F 17/04; H01F 27/255; H01F 27/28; H01F 3/10; H01F 19/08; H01F 27/2828
See application file for complete search history.

(56) References Cited

U.S. PATENT DOCUMENTS

| | | | | |
|---|---|---|---|---|
| 2016/0343490 | A1* | 11/2016 | Maeno ..... | H01F 27/325 |
| 2017/0288626 | A1* | 10/2017 | Kobayashi ..... | H03H 1/00 |

FOREIGN PATENT DOCUMENTS

| | | | |
|---|---|---|---|
| JP | 2004-349391 | A | 12/2004 |
| JP | 2010-258314 | A | 11/2010 |
| JP | 2011-086751 | A | 4/2011 |
| JP | 2018-056179 | A | 4/2018 |

* cited by examiner

WIRE-WOUND INDUCTOR COMPONENT

CROSS-REFERENCE TO RELATED APPLICATION

This application claims benefit of priority to Japanese Patent Application No. 2019-058921, filed Mar. 26, 2019, the entire content of which is incorporated herein by reference.

BACKGROUND

Technical Field

The present disclosure relates to a wire-wound inductor component.

Background Art

Electronic devices usually incorporate various inductor components. A wire-wound inductor component includes a core, a wire wound around the core, and a cover member that covers part of the wire on an upper face of the core. A top face of the cover member is to be suctioned onto a suction nozzle of an automatic surface mount machine when the wire-wound inductor component is mounted onto a circuit board as described, for example, in Japanese Unexamined Patent Application Publication No. 2004-349391.

SUMMARY

As the cover member, resin such as epoxy resin is commonly used in view of costs or handleability of wire-wound inductor components in a production process. However, wire-wound inductor components have been mostly designed with general consumer devices in mind. In the design of cover members made from resin, in particular, due consideration is rarely given to installation on vehicles or any other use under conditions that require a high degree of reliability.

Accordingly, the present disclosure provides a wire-wound inductor component suited for use under conditions that require a high degree of reliability.

A wire-wound inductor component according to an embodiment of the present disclosure includes a core including an axial portion that extends in an axial direction and is pillar-shaped and a first support and a second support disposed respectively on a first end and a second end in the axial direction of the axial portion; a first terminal electrode and a second terminal electrode disposed respectively on a bottom face of the first support and a bottom face of the second support; a wire wound around the axial portion, a first end portion and a second end portion of the wire being connected respectively to the first terminal electrode and the second terminal electrode; and a cover member that covers at least part of the wire on an upper face of the axial portion and has a terminal indentation depth of 0.85 μm or more. The adhesive strength of a top face of the cover member is less than or equal to 3.28 gf/mm$^2$.

The wire-wound inductor component configured as described above eliminates or reduces the possibility of cracking of the cover member and ensures handleability in production and mounting processes.

Other features, elements, characteristics and advantages of the present disclosure will become more apparent from the following detailed description with reference to the attached drawings.

DETAILED DESCRIPTION

Figure 1B:
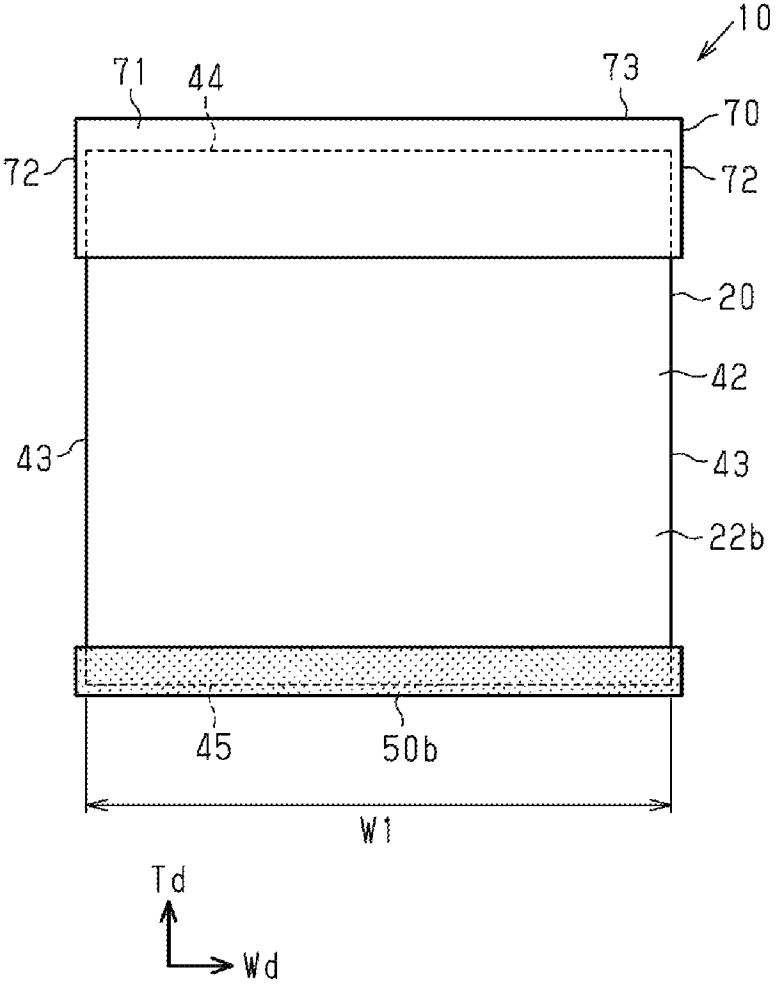
FIG. 1B is an end view of the wire-wound inductor component.

An embodiment of the present disclosure will be described below. Constituent elements illustrated in some of the accompanying drawings are scaled up for the purpose of facilitating the understanding of the present disclosure. Some constituent elements are not drawn to scale and the scale ratio may vary from drawing to drawing. In sectional views, some constituent elements are not hatched for the purpose of facilitating the understanding of the present disclosure.

A wire-wound inductor component 10 illustrated in FIGS. 1A, 1B, 2, and 3 is a surface-mount component that is to be mounted on, for example, a circuit board. The wire-wound inductor component 10 is included in, for example, an electronic circuit of a communication device or any other device mountable on vehicles (a car-mounted device). Alternatively, the wire-wound inductor component 10 may be included in to various devices such as general consumer devices, industrial devices, and medical devices.

The wire-wound inductor component 10 includes a core 20 including an axial portion 21, which extends in an axial direction and is substantially pillar-shaped, and a first support 22*a* and a second support 22*b*, which are disposed respectively on a first end and a second end in the axial direction of the axial portion 21; a first terminal electrode 50*a* and a second terminal electrode 50*b*, which are disposed respectively on a bottom face 45 of the first support 22*a* and a bottom face 45 of the second support 22*b*; a wire 60 wound around the axial portion 21, with a first end portion of the wire 60 being connected to the first terminal electrode 50*a* and a second end portion of the wire 60 being connected to the second terminal electrode 50*b*; and a cover member 70, which covers at least part of the wire 60 on an upper face of the axial portion 21.

The axial portion 21 is formed into a substantially quadrangular prism extending in the axial direction, namely, a longitudinal direction Ld. The axial portion 21 has an upper face 31, a lower face 32, and a pair of side faces 33. The upper face 31 and the lower face 32 are located on respective ends in a height (thickness) direction Td of the axial portion 21. Side faces of the pair of side faces 33 are located on respective ends in a width direction Wd of the axial portion 21. The height direction Td and the width direction Wd are orthogonal to the longitudinal direction Ld. The height direction Td is orthogonal to a top face 73 of the cover member 70. The width direction Wd is parallel to the top face 73 of the cover member 70. The orientation in the height direction Td on the cover member 70 side is herein referred to as "upper" and the orientation in the height direction Td on the first terminal electrode 50*a* side or the second terminal electrode 50*b* side is herein referred to as "lower".

Each of the first support 22*a* and the second support 22*b* is formed into a flange that is a parallelepiped having a substantially rectangular main face extending from the corresponding one of the first and second ends of the axial portion 21 in the height direction Td and the width direction Wd. The first support 22*a* and the second support 22*b* support the axial portion 21 in such a manner that the longitudinal direction Ld is parallel to a circuit board on which the wire-wound inductor component 10 is mounted. The first support 22*a* and the second support 22*b* are integral with the axial portion 21. Corner portions and edge portions of the axial portion 21, corner portions and edge portions of the first support 22*a*, and corner portions and edge portions of the second support 22*b* are preferably formed into curved or flattened surfaces by, for example, barreling or chamfering.

Figure 1A:
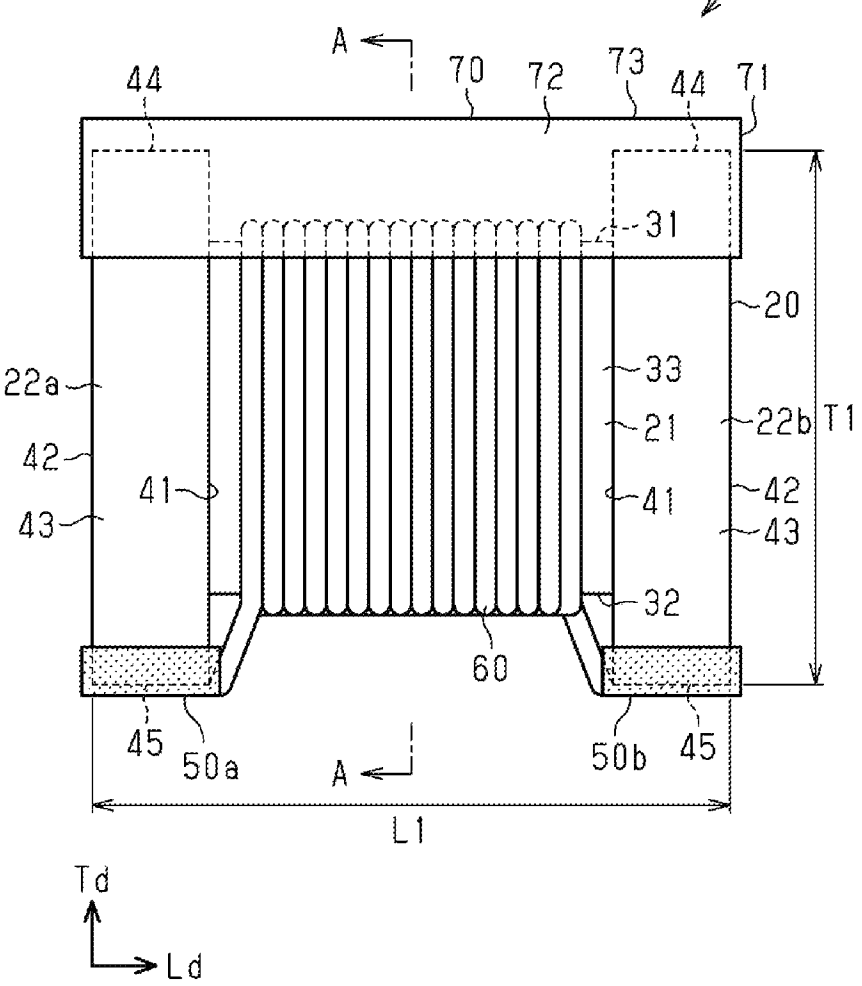
FIG. 1A is a front view of a wire-wound inductor component according to an embodiment.

As illustrated in FIGS. 1A and 1B, each of the first support 22*a* and the second support 22*b* has an inner face 41 facing the axial portion 21 (inward), an end face 42 opposite to the inner face 41 and facing outward, side faces of a pair of side faces 43 on respective ends in the width direction Wd, a top face 44 on the upper side in the height direction Td, and the bottom face 45 on the lower side in the height direction Td. The inner face 41 of the first support 22*a* faces the inner face 41 of the second support 22*b*. The bottom face 45 faces a circuit board on which the wire-wound inductor component 10 is mounted. The inner face 41 and the end face 42 are orthogonal to the longitudinal direction Ld. The side faces 43 are orthogonal to the width direction Wd. The top face 44 and the bottom face 45 are orthogonal to the height direction Td. The plane defined by the longitudinal direction Ld and the width direction Wd is herein referred to as a product plane.

For example, the core 20 of the wire-wound inductor component 10 according to the present embodiment has a length dimension L1 in the longitudinal direction Ld (the distance between the end face 42 of the first support 22*a* and the end face 42 of the second support 22*b*) of about 1.6 mm, a height dimension T1 in the height direction Td (the distance between the bottom face 45 and the top face 44 of each of the first support 22*a* and the second support 22*b*) of about 0.85 mm, and a width dimension W1 in the width direction Wd (the distance between side faces of the pair of side faces 43 of each of the first support 22*a* and the second support 22*b*) of about 0.8 mm. The length dimension L1, the height dimension T1, and the width dimension W1 of the core 20 are not limited to these values. For example, the length dimension L1 of the core 20 may be greater than or equal to 1.40 mm or less than or equal to 1.75 mm (i.e., from 1.40 mm to 1.75 mm). The core 20 is thus less prone to come into contact with components adjacent to the core 20 in the longitudinal direction Ld. Each of the height dimension T1 and the width dimension W1 of the core 20 may be greater than or equal to 0.6 mm and less than or equal to 1.09 mm (i.e., from 0.6 mm to 1.09 mm). The core 20 is thus less prone to come into contact with components adjacent to the core 20 in the height direction Td and components adjacent to the core 20 in the width direction Wd. The height dimension T1 of the core 20 may be equal to the width dimension W1 of the core 20.

Magnetic materials (e.g., nickel zinc (Ni—Zn) ferrite and manganese zinc (Mn—Zn) ferrite), alumina, and metal magnetic materials may be used as the material of the core 20. The core 20 may be obtained by compression-molding or sintering such a material in the form of powder. The core 20 may be a molded article formed from resin containing magnetic powder.

The first terminal electrode 50*a* and the second terminal electrode 50*b* are provided respectively on the first support 22*a* and the second support 22*b*. Each of the first terminal electrode 50*a* on the first support 22*a* and the second terminal electrode 50*b* on the second support 22*b* covers the entirety of the bottom face 45, an end portion of the inner face 41 on the bottom face 45 side, an end portion of the end face 42 on the bottom face 45 side, and end portions of side faces of the pair of side faces 43 on the bottom face 45 side. The first terminal electrode 50*a* and the second terminal electrode 50*b* may be formed by baking conductive paste containing, as a conductive component, silver mixed with glass powder and may be plated with, for example, Ni, Cu, or Sn as necessary.

The wire 60 is spirally wound around the axial portion 21. The wire 60 is wound directly on the axial portion 21 in such a manner that the individual windings of the wire 60 constitute a single layer on the axial portion 21. Instead of being wound into a single layer, the wire 60 may be wound doubly or triply around the axial portion 21 in a manner so as to form a plurality of layers. Alternatively, a plurality of wires 60 may be wound around the axial portion 21. The wire 60 includes, for example, a core wire having a substantially circular cross section and a coating covering the surface of the core wire. The principal component of the core wire may be a conductive metallic material such as Cu or Ag. The material of the coating may be an insulating resin material such as polyurethane, polyester, polyimide, polyamide, or a mixture thereof.

The first end portion and the second end portion of the wire 60 are electrically connected to the first terminal electrode 50*a* and the second terminal electrode 50*b*, respectively. The wire 60 may be connected to the first terminal electrode 50*a* and the second terminal electrode 50*b* by thermocompression bonding. For example, the wire 60 may be thermocompression bonded to layers of tin (Sn) plating of the first terminal electrode 50*a* and the second terminal electrode 50*b* such that the core wire of the wire 60 is electrically connected to the first terminal electrode 50*a* and the second terminal electrode 50*b*. Instead of thermocompression bonding, various known methods, such as soldering and welding, may be used to connect the wire 60 to the first terminal electrode 50*a* and the second terminal electrode 50*b*.

The diameter of the core wire of the wire 60 in cross section is preferably within a range of, for example, 14 to 20 μm and is more preferably within a range of 15 to 17 μm. In the present embodiment, the wire 60 has a diameter of about 16 μm. When the wire 60 has a larger diameter, an increase in resistance component may be suppressed. When the wire 60 has a smaller diameter, a greater number of windings of the wire 60 may be formed on the axial portion 21 and the wire 60 is less prone to lie off the outline of the core 20.

The cover member 70 is formed in a manner so as to cover part of the wire 60 on the upper face 31 of the axial portion 21. In the present embodiment, the cover member 70 is formed in a manner so as to cover the upper face 31 of the axial portion 21, the top face 44 of the first support 22*a*, and the top face 44 of the second support 22*b*. The cover member 70 has end faces of a pair of end faces 71 on respective ends in the longitudinal direction Ld, side faces of a pair of side faces 72 on respective ends in the width direction Wd, and the top face 73 in the same orientation in the height direction Td as the top face 44 of the first support 22*a* and the top face 44 of the second support 22*b*. The top face 73 of the cover member 70 is flat. End faces of the pair of end faces 71 and side faces of the pair of side faces 72 of the cover member 70 may or may not be flat. The term "flat" herein means that the surface roughness Ra is less than or equal to 50 μm. Owing to the cover member 70, an automatic surface mount machine may achieve suction without fail when, for example, the wire-wound inductor component 10 is mounted on a circuit board. The top face 73 is to be suctioned by the automatic surface mount machine. The cover member 70 also serves as a protective member that keeps the wire 60 from being scratched during suction on a suction nozzle, in production and mounting processes, and in use environments.

Figure 2:
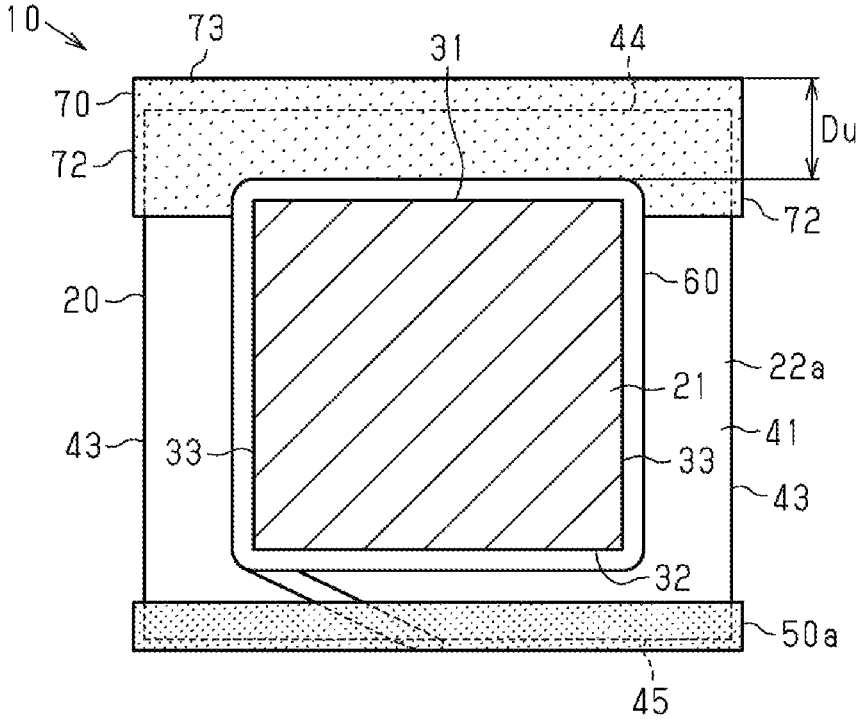
FIG. 2 is a sectional view taken along line A-A in FIG. 1A.
Figure 3:
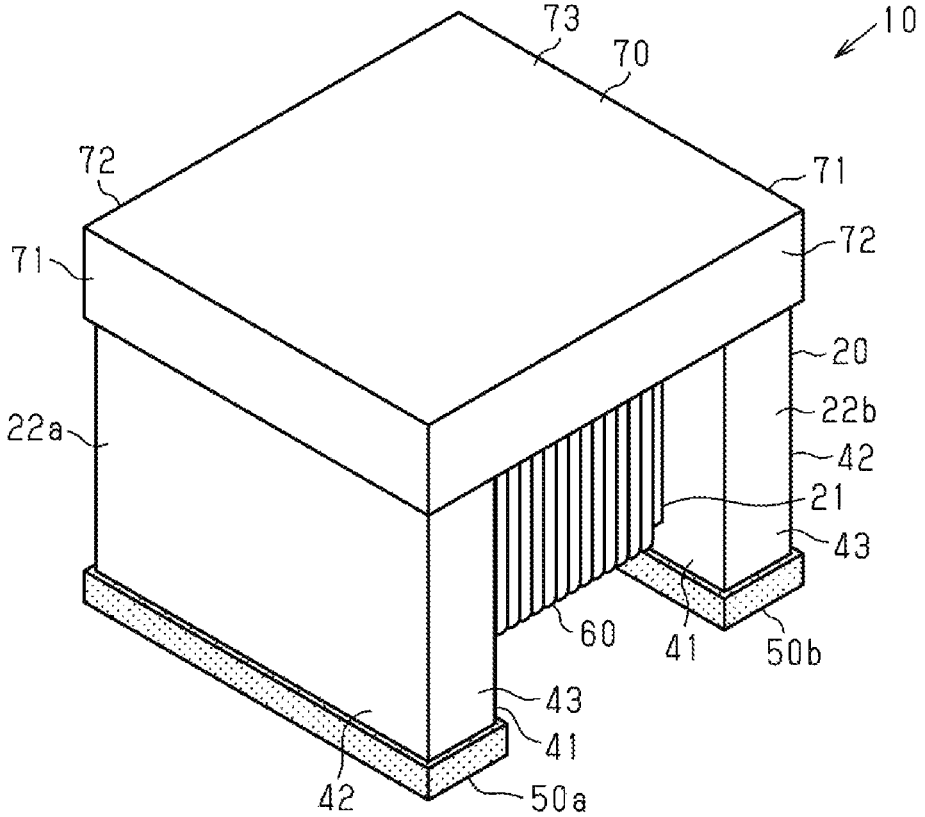
FIG. 3 is a perspective view of a wire-wound inductor component according to an embodiment.

As illustrated in FIG. 2, the cover member 70 has a thickness Du defined as the distance between the uppermost part of the wire 60 on the upper face 31 of the axial portion 21 and the top face 73 of the cover member 70. It is preferred that the thickness Du of the cover member 70 is greater than or equal to 27 μm and less than or equal to 109 μm (i.e., from 27 μm to 109 μm) and is more preferably greater than or equal to 30 μm and less than or equal to 107 μm (i.e., from 30 μm to 107 μm).

The cover member 70 has a terminal indentation depth of 0.85 μm or more and an adhesive strength of 3.28 gf or less. The material of the cover member may be, for example, resin such as acrylic resin, urethane resin, or silicone resin. In the present embodiment, acrylic resin is used as the material of the cover member 70. As the cover member 70, resin having a softening point, as determined by thermomechanical analysis (TMA), of 45° C. or lower is preferred, and resin having a softening point, as determined by TMA, of 40° C. or lower is more preferred. The cover member 70 has, for example, a softening point of about 36° C. Various known methods, such as UV curing and heat curing, may be used to cure the cover member 70.

The cover member 70 may contain a magnetic material, such as metallic magnetic powder or ferrite powder. In this case, the inductance value (L value) of the wire-wound inductor component 10 may be increased. Alternatively, the cover member 70 may contain no magnetic materials and may be a non-magnetic body. In this case, magnetic loss may be reduced and the Q value of the wire-wound inductor component 10 may be increased. Still alternatively, the cover member 70 may be a mixture of different resin materials or may contain non-magnetic filler, such as silica or barium sulfate. In this case, the thermal expansion coefficient may be adjusted.

It is preferred that the cover member 70 maintains a terminal indentation depth of 0.85 μm or more after being subjected to thermal shock. Thermal shock may be given in accordance with a test method involving repeated cycles of leaving the wire-wound inductor component 10 to stand at −55° C. for 30 minutes and at 125° C. for additional 30 minutes. The "thermal shock test conducted in a temperature range of −55 to 125° C." herein refers to the aforementioned test method.

More specifically, it is preferred that the cover member 70 maintains a terminal indentation depth of 0.85 μm or more after undergoing 1,000 cycles in the thermal shock test conducted in a temperature range of −55 to 125° C. It is more preferred that the cover member 70 maintains a terminal indentation depth of 0.85 μm or more after undergoing 1,500 cycles in the thermal shock test. It is most preferred that the cover member 70 maintains a terminal indentation depth of 0.85 μm or more after undergoing 2,000 cycles in the thermal shock test.

As will be described later, the cover member 70 having a terminal indentation depth of 0.85 μm or more resists cracking in the thermal shock test. After undergoing these cycles, this cover member 70 is still capable of resisting cracking in additional thermal shock tests.

The terminal indentation depth is measured as follows.

Testing Device:

ENT-2100 (Elionix Inc.), Indenter: Berkovich indenter (65.03°, As(h)=26.43 $h^2$)

Measurement Conditions:

Indenter load at the start: 0 mgf

Indenter load at the end: 350 mgf

Number of steps: 500

Interval between steps: 20 msec

Temperature: 30° C.

Figure 4:
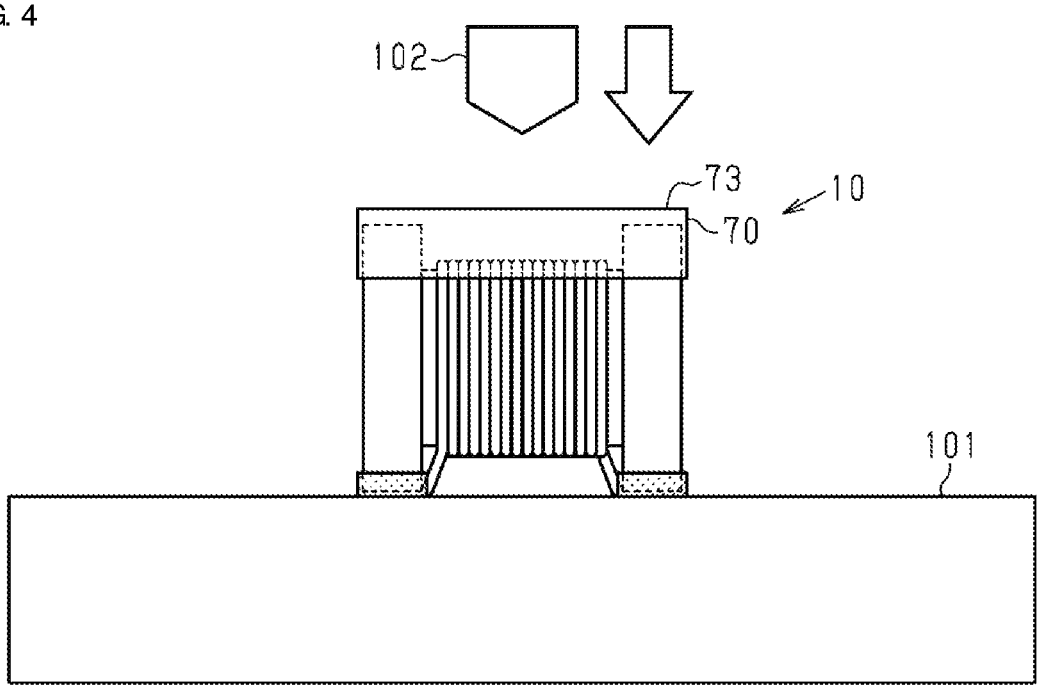
FIG. 4 is a diagram for describing a test for measuring the indentation depth.

FIG. 4 illustrates the outline of measurement of the terminal indentation depth. The measurement of the terminal indentation depth involves placing the wire-wound inductor component 10 on a test stage 101, which is constructed of a stainless steel substrate, and pressing an indenter 102 of the test device against the center of the top face 73 of the cover member 70 of the wire-wound inductor component 10 on the test stage 101 by using the aforementioned test device. Under the aforementioned measurement conditions, the depth of a recess formed in the cover member 70 by the indenter 102 (indentation amount of the indenter 102) under an indenter load of 350 mgf is measured and defined as a reference depth of the recess.

The adhesive strength of the cover member 70 is measured as follows.

Test Device: TAC-1000 (tackiness tester manufactured by Rhesca Co., Ltd)

Measuring Method: probe tack method

Measurement Conditions:

Probe temperature and stage temperature: 20 to 30° C.

Diameter of probe: 5 mm

Material of test stage: SUS430

Operation pattern: Pattern 5

Press time: 0.5 mm/sec

Press load: 1,000 gf

Press holding time: 10 sec

Lifting speed: 0.1 mm/sec

Final lifting distance: 1 mm

Figure 5:
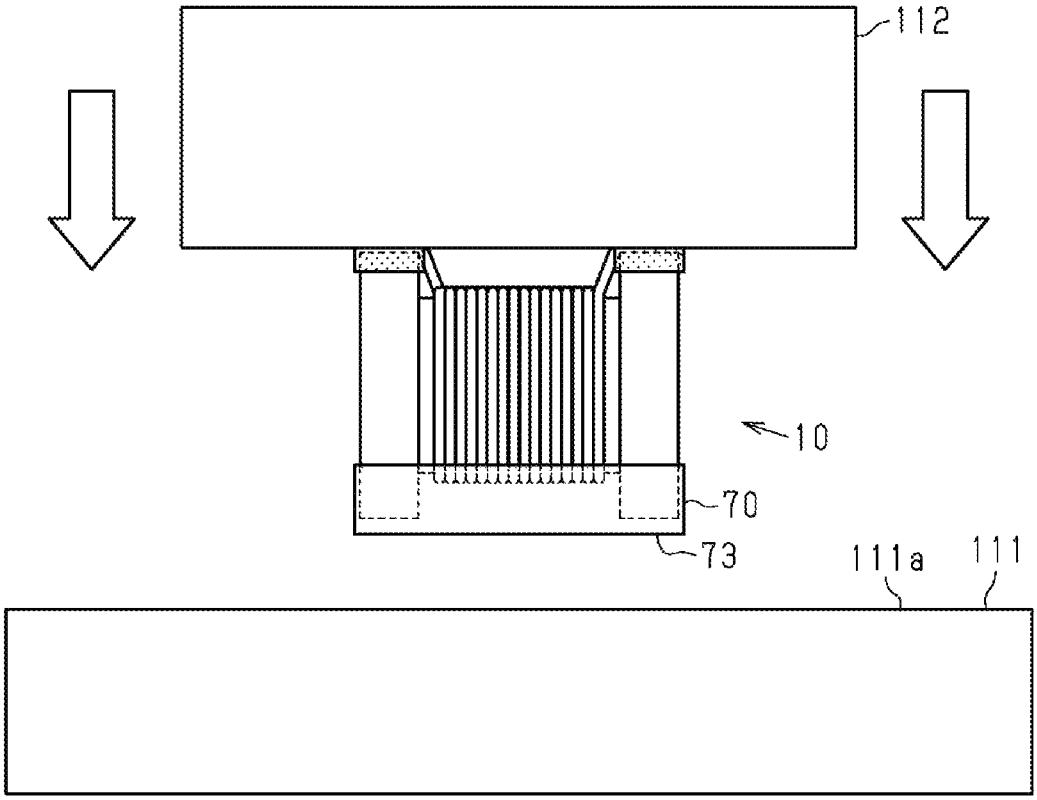
FIG. 5 is a diagram for describing a test for measuring the adhesive strength.

FIG. 5 illustrates the outline of measurement of the adhesive strength of the cover member 70. For measurement of adhesive strength, the wire-wound inductor component 10 is fixed to a measurement probe 112 in such a manner that the top face 73 of the cover member 70 of the wire-wound inductor component 10 faces an upper face 111*a* of a test stage 111, which is constructed of a stainless steel substrate. The measurement probe 112 includes a load cell.

Figure 6:
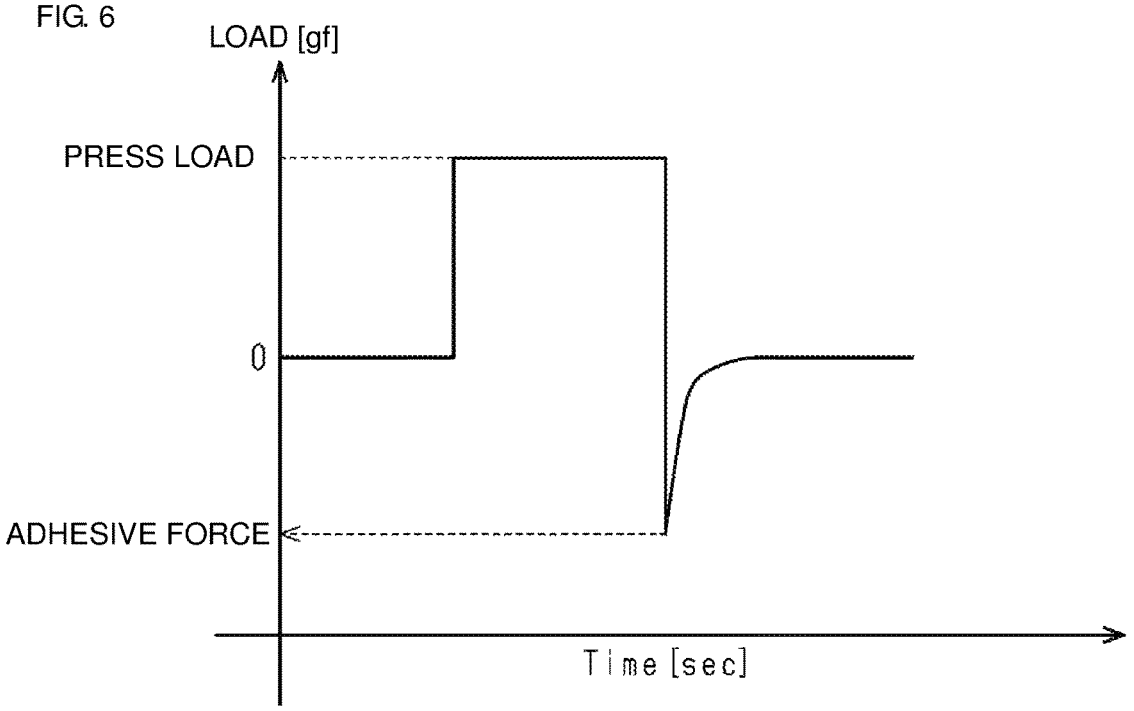
FIG. 6 is a diagram for describing a measurement method employed in the test for measuring the adhesive strength.

FIG. 6 illustrates load changes measured by the measurement probe 112. Referring to FIG. 6, the horizontal axis represents time and the vertical axis represents load measured by using the measurement probe 112. The measurement probe 112 in the state illustrated in FIG. 5 is then moved downward and presses the top face 73 of the cover member 70 of the wire-wound inductor component 10 against the upper face 111*a* of the test stage 111 by applying the pressure set forth in the aforementioned measurement conditions. Subsequently, the measurement probe 112 is moved upward. The adhesive strength is determined by measuring, with the measurement probe 112, negative pressure at the moment when the cover member 70 of the wire-wound inductor component 10 is separated from the upper face 111*a* of the test stage 111 in the course of the above movement.

Effects

The following describes the workings of the wire-wound inductor component 10. The wire-wound inductor component 10 includes the core 20 including the axial portion 21, which extends in the axial direction (the longitudinal direction Ld) and is substantially pillar-shaped, and the first support 22*a* and the second support 22*b*, which are disposed respectively on the first end and the second end in the axial direction of the axial portion 21; the first terminal electrode 50*a* and the second terminal electrode 50*b*, which are disposed respectively on the bottom face 45 of the first support 22*a* and the bottom face 45 of the second support 22*b*; the wire 60 wound around the axial portion 21, with the first end portion of the wire 60 being connected to the first terminal electrode 50*a* and the second end portion of the wire 60 being connected to the second terminal electrode 50*b*; and the cover member 70, which covers at least part of the wire 60 on the upper face of the axial portion 21, has a terminal indentation depth of 0.85 μm or more, with an adhesive strength of the top face 73 being less than or equal to 3.28 gf/mm$^2$.

In consideration of installation on vehicles and other possible usages under conditions that require a high degree of reliability, the inventors in the present application conducted thermal shock tests on the wire-wound inductor component 10 under conditions involving a temperature range of −55 to 125° C., which is wider than the temperature range in which general consumer devices are used. The inventors found that the cover member 70 fixed to the wire-wound inductor component 10 and made from the commonly-used epoxy resin could fail to withstand the thermal shock tests and could be cracked.

The inventors in the present application then realized that giving greater flexibility to the cover member 70 could improve the ability to withstand thermal shock tests. The inventors conducted a study involving evaluations based on the aforementioned original measurement method and found that the cover member 70 having a terminal indentation depth of 0.85 μm or more escaped being cracked in the thermal shock tests.

The study showed that the greater the terminal indentation depth was, the further the cover member 70 was capable of resisting cracking. However, the inventors in the present application were faced with a problem associated with the approach of increasing the terminal indentation depth. Specifically, it was found that when the cover member 70 had a greater terminal indentation depth and greater flexibility, the handleability of the wire-wound inductor component 10 would deteriorate due to greater adhesive strength of resin. The inventors found that when a plurality of wire-wound inductor components 10 were disposed in such a manner that respective cover members 70 came into contact with each other, the wire-wound inductor components 10 stuck to each other and were difficult to handle in production and mounting processes.

Furthermore, evaluations based on the aforementioned original measurement method made the inventors in the present application realize that the cover members 70 of the wire-wound inductor components 10 were less prone to stick to each other when the top faces 73 of the respective cover members 70 had an adhesive strength of 3.28 gf/mm$^2$ or less as determined by the measurement method.

The wire-wound inductor component 10 according to the present embodiment is therefore configured in such a manner that the cover member 70 has a terminal indentation depth of 0.85 μm or more and the top face 73 of the cover member 70 has an adhesive strength of 3.28 gf/mm$^2$ or less. Owing to these features, the individual cover members 70 resist cracking in the thermal shock tests conducted in a temperature range of −55 to 125° C. and are less prone to stick to each other. The wire-wound inductor component 10 suited to use under conditions that require a high degree of reliability is provided accordingly.

As described above, the present embodiment produces the following effects.

(1) The wire-wound inductor component 10 includes the core 20 including the axial portion 21, which extends in the axial direction and is substantially pillar-shaped, and the first support 22*a* and the second support 22*b*, which are disposed respectively on the first end and the second end in the axial direction of the axial portion 21; the first terminal electrode 50*a* and the second terminal electrode 50*b*, which are disposed respectively on the bottom face 45 of the first support 22*a* and the bottom face 45 of the second support 22*b*; the wire 60 wound around the axial portion 21, with the first end portion of the wire 60 being connected to the first terminal electrode 50*a* and the second end portion of the wire 60 being connected to the second terminal electrode 50*b*; and the cover member 70, which covers at least part of the wire 60 on the upper face of the axial portion 21.

The wire-wound inductor component 10 configured as described above eliminates or reduces the possibility of cracking of the cover member 70 and ensures handleability in production and mounting processes. Thus, the reliability of the wire-wound inductor component 10 is less prone to deteriorate.

(2) After undergoing a thermal shock test conducted in a temperature range of −55 to 125° C., the cover member 70 has a terminal indentation depth of 0.85 μm or more. Owing to this feature, the wire-wound inductor component 10 is suited for use under conditions that require a high degree of reliability.

(3) The thickness Du of the cover member 70 defined as the distance between the uppermost part of the wire 60 on the upper face 31 of the axial portion 21 and the top face 73 of the cover member 70 is greater than or equal to 27 μm and less than or equal to 109 μm (i.e., from 27 μm to 109 μm). This feature ensures sufficient coverage of the uppermost part of the wire 60 and the flatness of the surface of the cover member 70 and enables the cover member 70 to achieve a profile reduction and hardenability.

The inventors in the present application produced examples of the wire-wound inductor component 10 to make evaluations, which are as follows.

Examination of Occurrence of Cracking

Referring to Table 1, Samples 1 to 5, in which the respective cover members 70 had different terminal indentation depths, were produced as examples and comparative examples of the wire-wound inductor component 10 and were subjected to 2,000 cycles in a thermal shock test conducted in a temperature range of −55 to 125° C. After undergoing the thermal shock test, the cover members 70 of Samples 1 to 5 were examined under an optical microscope and an electron microscope to see if there was any crack. The terminal indentation depths of the cover members 70 of Samples 1 to 5 were varied by forming the cover members 70 from resins of different types or of different compositions or by forming the cover members 70 under different curing conditions.

Table 1 shows results of the examinations conducted to see if there was any crack in each of Samples 1 to 5 after the thermal shock test. In the "thermal shock test" field of Table 1, Samples 1 to 5 are marked with "G" indicating that cracks were found or with "NG" indicating that no cracks were found.

TABLE 1

| No. | 1 | 2 | 3 | 4 | 5 |
|---|---|---|---|---|---|
| Terminal Indentation Depth (μm) | 11.45 | 6.59 | 3.63 | 0.85 | 0.12 |
| Thermal Shock Test | G | G | G | G | NG |

Table 1 indicates that in Sample 5, in which the cover member 70 had a terminal indentation depth of 0.12 μm, cracks in the cover member 70 were found after the thermal shock test and that in Samples 1 to 4, in which the cover members 70 each had a terminal indentation depth of 0.85 μm or more, no cracks in the cover members 70 were found after the thermal shock test.

Examination of Adhesive Strength and Sticking of Cover Members 70

Referring to Table 2, Samples 1 to 35, in which the respective cover members 70 had different adhesive strengths, were produced as examples and comparative examples of the wire-wound inductor component 10 and the cover members 70 of each sample were brought into contact with each other, that is, a resin-to-resin contact was established to see if they stuck to each other. Referring to Table 2, the adhesive strength [gf] was determined in accordance with the aforementioned measurement method and the area [$mm^2$] of the top face 73 of the cover member 70 was then measured. From the adhesive strength and the area, the adhesive strength of the top face 73 of the cover member 70 per unit area [$gf/mm^2$] was calculated. The adhesive strength of the cover members 70 of Samples 1 to 35 were varied by forming the cover members 70 from resins of different types or of different compositions or by forming the cover members 70 under different curing conditions.

TABLE 2

| No. | Adhesive Strength [gf] | Area of Cover Member [$mm^2$] | Adhesive Strength per $mm^2$ [$gf/mm^2$] | Sticking of Cover Members |
|---|---|---|---|---|
| 1 | 5 | 2.88 | 1.74 | not observed |
| 2 | 4.5 | 2.85 | 1.58 | not observed |
| 3 | 5.5 | 2.89 | 1.9 | not observed |
| 4 | 8.25 | 2.96 | 2.79 | not observed |
| 5 | 3.25 | 2.88 | 1.13 | not observed |
| 6 | 6 | 3.01 | 1.99 | not observed |
| 7 | 5.25 | 2.86 | 1.84 | not observed |
| 8 | 8.75 | 2.89 | 3.03 | not observed |
| 9 | 7.25 | 2.94 | 2.46 | not observed |
| 10 | 4.75 | 2.91 | 1.63 | not observed |
| 11 | 6 | 2.89 | 2.07 | not observed |

TABLE 2-continued

| No. | Adhesive Strength [gf] | Area of Cover Member [$mm^2$] | Adhesive Strength per $mm^2$ [$gf/mm^2$] | Sticking of Cover Members |
|---|---|---|---|---|
| 12 | 5.75 | 2.99 | 1.92 | not observed |
| 13 | 6.25 | 2.92 | 2.14 | not observed |
| 14 | 7.75 | 2.91 | 2.66 | not observed |
| 15 | 9.75 | 2.97 | 3.28 | not observed |
| 16 | 7 | 2.89 | 2.42 | not observed |
| 17 | 2.5 | 2.9 | 0.86 | not observed |
| 18 | 5 | 2.9 | 1.72 | not observed |
| 19 | 6 | 2.94 | 2.04 | not observed |
| 20 | 5 | 2.96 | 1.69 | not observed |
| 21 | 6.75 | 2.93 | 2.3 | not observed |
| 22 | 6.25 | 2.9 | 2.15 | not observed |
| 23 | 6 | 2.91 | 2.06 | not observed |
| 24 | 6 | 2.95 | 2.03 | not observed |
| 25 | 5.5 | 2.99 | 1.84 | not observed |
| 26 | 4.75 | 2.96 | 1.61 | not observed |
| 27 | 4.75 | 2.99 | 1.59 | not observed |
| 28 | 7 | 2.97 | 2.36 | not observed |
| 29 | 7 | 2.98 | 2.35 | not observed |
| 30 | 4 | 2.91 | 1.38 | not observed |
| 31 | 21 | 2.74 | 7.68 | observed |
| 32 | 23.25 | 2.66 | 8.74 | observed |
| 33 | 29.75 | 2.65 | 11.23 | observed |
| 34 | 19.25 | 2.7 | 7.13 | observed |
| 35 | 20.75 | 2.74 | 7.58 | observed |

Table 2 indicates that Samples 1 to 30, in which the adhesive strength of each of the top faces 73 of the cover members 70 was smaller than or equal to 3.28 $gf/mm^2$, involved no sticking of the cover members 70 and that Samples 31 to 35, in which the adhesive strength of each of the top faces 73 of the cover members 70 was greater than 3.28 $gf/mm^2$, involved sticking of the cover members 70.

Modifications

Figure 7A:
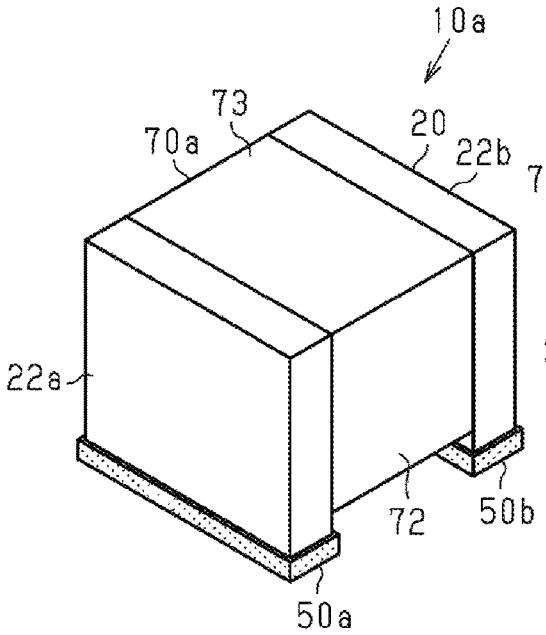
FIG. 7A is a perspective view of a wire-wound inductor component according to a modification.
Figure 7B:
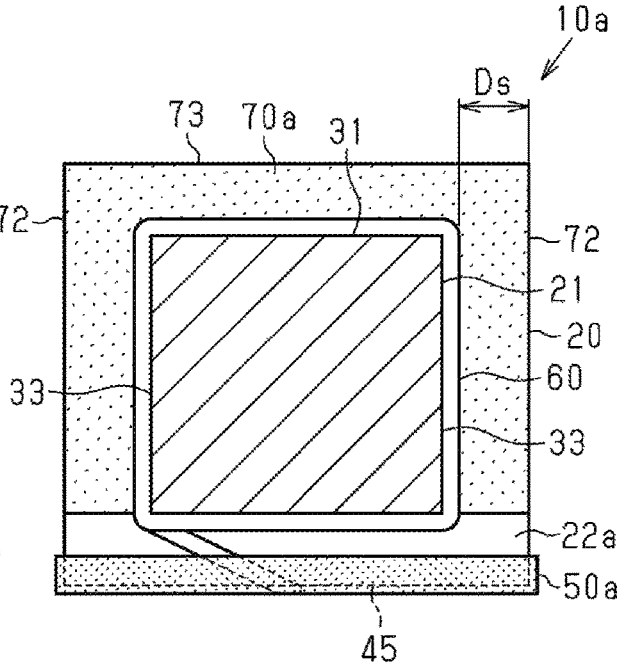
FIG. 7B is a sectional view of the wire-wound inductor component.

The embodiment above may be implemented as follows. A wire-wound inductor component 10*a* illustrated in FIGS. 7A and 7B includes a cover member 70*a*, which does not cover the first support 22*a* and the second support 22*b* and lies only between the first support 22*a* and the second support 22*b* to cover part of the wire 60 on the upper face 31 and part of the wire 60 on the side faces 33 of the axial portion 21. In this case, it is preferred that a thickness Ds defined as the distance between the outermost part of the wire 60 on each of the side faces 33 of the axial portion 21 and the corresponding surface (the corresponding side face 72) of the cover member 70*a* is smaller than or equal to 19 μm. Owing to this feature, part of the wire 60 on the side faces 33 of the axial portion 21 is protected, with reduced effects on the outside.

Figure 8A:
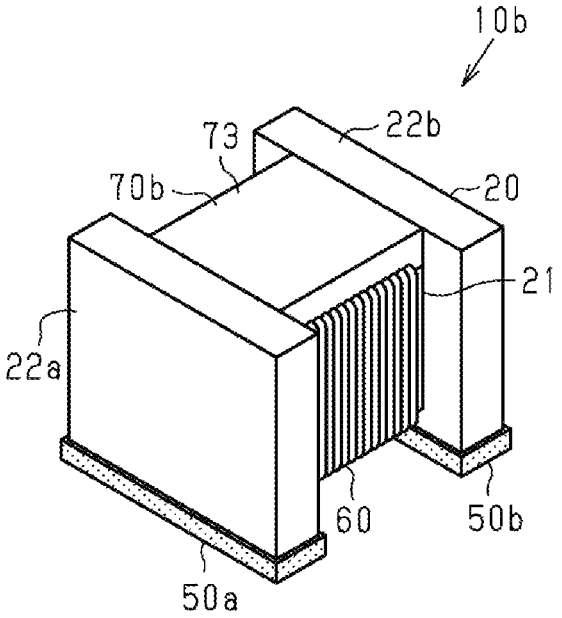
FIG. 8A is a perspective view of a wire-wound inductor component according to a modification.
Figure 8B:
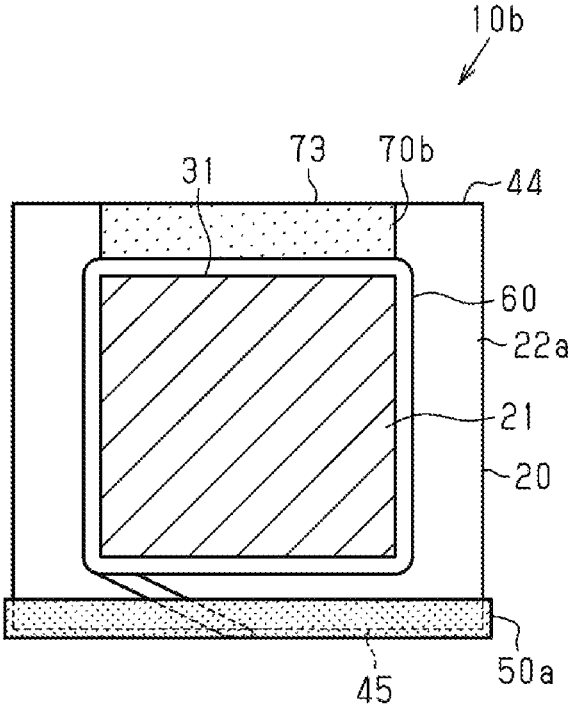
FIG. 8B is a sectional view of the wire-wound inductor component.

A wire-wound inductor component 10*b* illustrated in FIGS. 8A and 8B includes a cover member 70*b*, which does not cover the first support 22*a* and the second support 22*b* and lies only between the first support 22*a* and the second support 22*b* to cover only part of the wire 60 on the upper face 31 of the axial portion 21 without covering part of the wire 60 on the side faces 33 of the axial portion 21. As in the embodiment above, this feature of the wire-wound inductor component 10*b* ensures sufficient coverage of the uppermost part of the wire 60 and the flatness of the surface of the cover member 70*b* and enables the cover member 70*b* to achieve a profile reduction and hardenability.

Figure 9A:
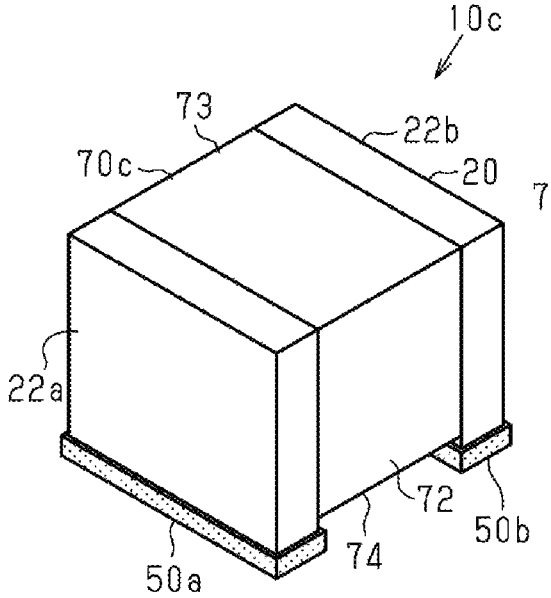
FIG. 9A is a perspective view of a wire-wound inductor component according to a modification.
Figure 9B:
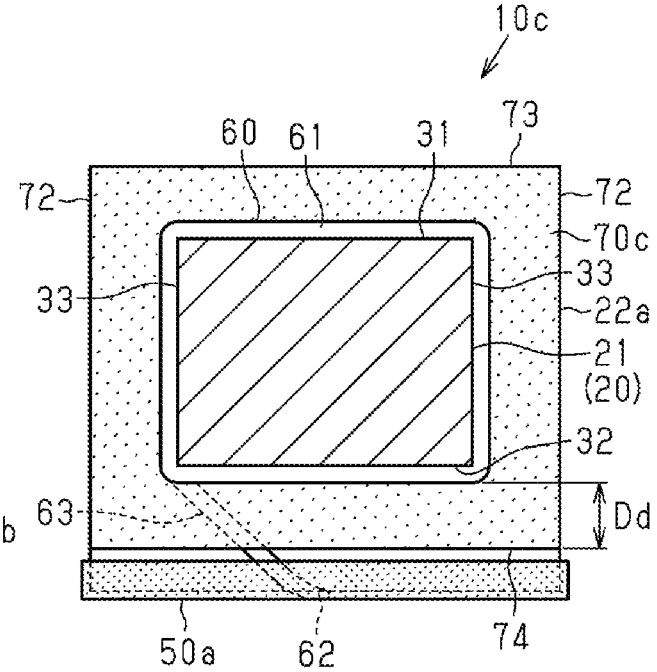
FIG. 9B is a sectional view of the wire-wound inductor component.

A wire-wound inductor component 10*c* illustrated in FIGS. 9A and 9B includes a cover member 70*c*, which lies only between the first support 22*a* and the second support 22*b* of the core 20 to cover part of the wire 60 on the upper face 31, part of the wire 60 on the side faces 33, and part of the wire 60 on the lower face 32 of the axial portion 21. The cover member 70*c* partially covers a bridging portion 63 of the wire 60 located between a winding portion 61 wound around the axial portion 21 and a connection portion 62 connected to the first terminal electrode 50*a* and the second terminal electrode 50*b*. In this case, it is preferred that a thickness Dd defined as the distance between the lowermost part of the wire 60 on the lower face 32 of the axial portion 21 and the surface (the lower face 74) of the cover member 70*c* is greater than or equal to 107 μm and less than or equal to 199 μm (i.e., from 107 μm to 199 μm). Owing to this feature, part of the wire 60 on the lower face 32 of the axial portion 21 is protected and ease of coating is ensured within the bounds of having reduced effects on the outer shape. This feature also eliminates or reduces the possibility that a break in the wire 60 will occur due to application of a resin coating after the wire-wound inductor component 10 is mounted.

Each of the cover members 70*a*, 70*b*, and 70*c* of the wire-wound inductor components 10*a*, 10*b*, and 10*c* described above may be formed in a manner so as to cover the top face 44 of the first support 22*a* and the top face 44 of the second support 22*b*. Alternatively, each of the cover members 70*a*, 70*b*, and 70*c* may be formed in a manner so as to cover the end face 42 and the side faces 43 of the first support 22*a* and the end face 42 and the side faces 43 of the second support 22*b*.

Figure 10:
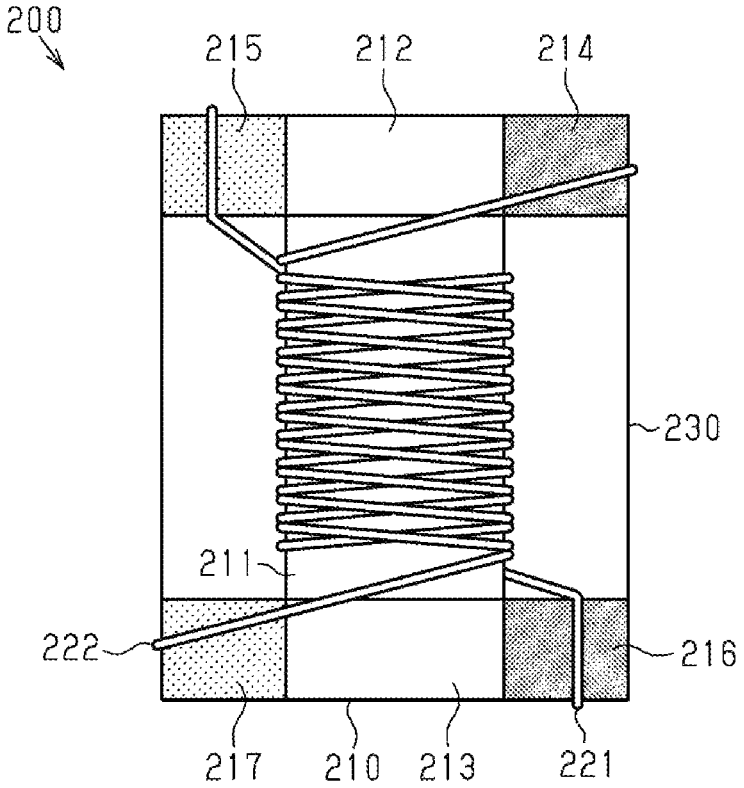
FIG. 10 is a bottom view of a wire-wound inductor component according to a modification.

In the embodiment above, only one wire 60 is wound around the core 20. Alternatively, a wire-wound inductor component 200 illustrated in FIG. 10 includes a plurality of wires (two wires in FIG. 10, namely, wires 221 and 222), which are wound around an axial portion 211 of a core 210. A first support 212 is provided with a first terminal electrode 214 and a second terminal electrode 215, and a second support 213 is provided with a third terminal electrode 216 and a fourth terminal electrode 217. A first end portion of the wire 221 is connected to the first terminal electrode 214 of the first support 212, and a second end portion of the wire 221 is connected to the third terminal electrode 216 of the second support 213. A first end portion of the wire 222 is connected to the second terminal electrode 215 of the first support 212, and a second end portion of the wire 222 is connected to the fourth terminal electrode 217 of the second support 213. Referring to FIG. 10, only two wires, namely, the wires 221 and 222 are wound around the core 210. In some embodiments, only three wires may be wound around the core 210. Such a wire-wound inductor component including a plurality of wires is applicable to devices such as, a transformer, a common mode filter, and a balun. Although the wires are connected to the corresponding terminal electrodes in FIG. 10, the wires may be connected to a common terminal electrode in a manner so as to be electrically in parallel. This configuration may reduce the direct-current resistance of the wires.

While some embodiments of the disclosure have been described above, it is to be understood that variations and modifications will be apparent to those skilled in the art without departing from the scope and spirit of the disclosure. The scope of the disclosure, therefore, is to be determined solely by the following claims.

What is claimed is:

1. A wire-wound inductor component comprising:

a core including an axial portion that extends in an axial direction and is pillar-shaped, and a first support and a second support disposed respectively on a first end and a second end in the axial direction of the axial portion;

a first terminal electrode and a second terminal electrode disposed respectively on a bottom face of the first support and a bottom face of the second support;

a wire wound around the axial portion, a first end portion and a second end portion of the wire being connected respectively to the first terminal electrode and the second terminal electrode; and a cover member that covers at least part of the wire on an upper face of the axial portion and has a terminal indentation depth of 0.85 μm or more, an adhesive strength of a top face of the cover member being less than or equal to 3.28 gf/mm$^2$.

2. The wire-wound inductor component according to claim 1, wherein after undergoing 1,000 cycles in a thermal shock test conducted in a temperature range of −55 to 125° C., the cover member has a terminal indentation depth of 0.85 μm or more.

3. The wire-wound inductor component according to claim 2, wherein after undergoing 1,500 cycles in a thermal shock test conducted in a temperature range of −55 to 125° C., the cover member has a terminal indentation depth of 0.85 μm or more.

4. The wire-wound inductor component according to claim 3, wherein after undergoing 2,000 cycles in a thermal shock test conducted in a temperature range of −55 to 125° C., the cover member has a terminal indentation depth of 0.85 μm or more.

5. The wire-wound inductor component according to claim 1, wherein a thickness of the cover member defined as a distance between an uppermost part of the wire on the upper face of the axial portion and the top face of the cover member is from 27 μm to 109 μm.

6. The wire-wound inductor component according to claim 5, wherein the thickness of the cover member is from 30 μm to 107 μm.

7. The wire-wound inductor component according to claim 1, wherein the cover member covers part of the wire on a side face of the axial portion, and a thickness of the cover member defined as a distance between an outermost part of the wire on the side face of the axial portion and a side face of the cover member is less than or equal to 19 μm.

8. The wire-wound inductor component according to claim 1, wherein the cover member covers part of the wire on a lower face of the axial portion, and a thickness of the cover member defined as a distance between a lowermost part of the wire on the lower face of the axial portion and a lower face of the cover member is from 107 μm to 199 μm.

9. The wire-wound inductor component according to claim 1, wherein a width dimension in a lateral direction of a product plane of the core is from 0.60 mm to 1.09 mm.

10. The wire-wound inductor component according to claim 1, wherein a length dimension in a longitudinal direction of a product plane of the core is from 1.40 mm to 1.75 mm.

11. The wire-wound inductor component according to claim 1, wherein the wire is only one wire.

12. The wire-wound inductor component according to claim 1, wherein the first terminal electrode covers an entirety of a bottom face of the first support, and the second terminal electrode covers an entirety of the second support.

13. The wire-wound inductor component according to claim 1, wherein the wire are only two wires.

14. The wire-wound inductor component according to claim 1, wherein the wire are only three wires.

15. The wire-wound inductor component according to claim 1, wherein the top face of the cover member is flat.

16. The wire-wound inductor component according to claim 1, wherein the cover member covers part of the wire on a side face of the axial portion, and a side face of the cover member covering the side faces of the axial portion are flat.

17. The wire-wound inductor component according to claim 2, wherein a thickness of the cover member defined as a distance between an uppermost part of the wire on the upper face of the axial portion and the top face of the cover member is from 27 μm to 109 μm.

18. The wire-wound inductor component according to claim 2, wherein the cover member covers part of the wire on a side face of the axial portion, and a thickness of the cover member defined as a distance between an outermost part of the wire on the side face of the axial portion and a side face of the cover member is less than or equal to 19 μm.

19. The wire-wound inductor component according to claim 2, wherein the cover member covers part of the wire on a lower face of the axial portion, and a thickness of the cover member defined as a distance between a lowermost part of the wire on the lower face of the axial portion and a lower face of the cover member is from 107 μm to 199 μm.

20. The wire-wound inductor component according to claim 2, wherein a width dimension in a lateral direction of a product plane of the core is from 0.60 mm to 1.09 mm.

* * * * *